US008232467B1

(12) United States Patent
Goldberg

(10) Patent No.: US 8,232,467 B1
(45) Date of Patent: Jul. 31, 2012

(54) FRET RUNNER

(76) Inventor: Lawrence Goldberg, Vancouver, WA (US)

( * ) Notice: Subject to any disclaimer, the term of this patent is extended or adjusted under 35 U.S.C. 154(b) by 0 days.

(21) Appl. No.: 12/721,267

(22) Filed: Mar. 10, 2010

Related U.S. Application Data

(60) Provisional application No. 61/209,858, filed on Mar. 12, 2009.

(51) Int. Cl.
*G10D 15/00* (2006.01)

(52) U.S. Cl. ..... 84/470 R; 84/483.1

(58) Field of Classification Search ..... 84/470 R, 84/483.1, 483.2, 477 R
See application file for complete search history.

(56) References Cited

U.S. PATENT DOCUMENTS

| | | | |
|---|---|---|---|
| 4,069,737 | A | 1/1978 | Andersson |
| 5,386,757 | A | 2/1995 | Derrick |
| 5,945,618 | A | 8/1999 | Bennett |
| 6,218,603 | B1 | 4/2001 | Coonce |
| 2008/0072738 | A1 * | 3/2008 | Plamondon et al. ..... 84/423 R |

OTHER PUBLICATIONS http://en.wikipedia.org/wiki/Colored_music_notation Please keep in mind this page is available for editing by anyone at any time but this is where I got the information about Dr. George Rogers color notation experiments.
More than 30 years of devouring every music book I could get my hands on but nothing else comes to mind that reflects directly on this matter.

* cited by examiner

*Primary Examiner* — Kimberly Lockett

(57) ABSTRACT

A colorized musical notation system could be embodied as a computer that can combine assigned colors representing musical notes with a scale degree pattern and visually display a selected portion of the result for the purpose of directing someone in a musical performance. The visual manifestation could be enhanced by including mnemonics along with interconnected fingerboard patterns that provide self-contained directions for playing common scales such as the major pentatonic, the minor pentatonic, and the blues scales, along with all seven modes. Chords could be constructed by playing selected scale degree tones simultaneously rather than consecutively as with scales. The computer could also present a means of suggesting tone combinations to create particular aural and psychological effects. An exhaustive selection of scales and chords may be constructed if one knows the proper formulas. The colorized notation system could be used to construct written musical notation.

16 Claims, 7 Drawing Sheets

Fig. 8

| | |
|---|---|
| C = "Canary" Yellow | C sharp / D flat = Dark "Canary" Yellow |
| D = "Deep" Purple | D sharp / E flat = Dark "Deep" Purple |
| E = Ebony | |
| F = "Fire" Red or Orange | F sharp / G flat = Dark "Fire" Red |
| G = Gray | G sharp / A flat = Dark Gray |
| A = "Apple" Green | A sharp / B flat = Dark "Apple" Green |
| B = Blue | |

Fig. 9

| Name of Mode | Musical Styles | Scale Pattern | Example in C | Spelling |
|---|---|---|---|---|
| Ionian | All | W W H W W W H | C D E F G A B C | R 2 3 4 5 6 7 |
| Dorian | Jazz, some Classical | W H W W W H W | D E F G A B C D | R 2 iii 4 5 6 vii |
| Phrygian | Exotic/ Arabian<br>Metallica | H W W W H W W | E F G A B C D E | R ii iii 4 5 vi vii |
| Lydian | Fusion and Progressive<br>Steve Vai & Joe Satriani | W W W H W W H | F G A B C D E F | R 2 3 v 5 6 7 |
| Mixolydian | Jazz, Blues, Celtic,<br>Renaissance,<br>Old English | W W H W W H W | G A B C D E F G | R 2 3 4 5 6 vii |
| Aeolian | All Types | W H W W H W W | A B C D E F G A | R 2 iii 4 5 vi vii |
| Locrian | Creepy, scary<br>seldom used | H W W H W W W | B C D E F G A B | R iii iv 4 vi vii viii |

Fig. 10

| Name of Scale | Scale Pattern | Example in C | Spelling |
|---|---|---|---|
| Major | W W H W W W H | C D E F G A B C | R 2 3 4 5 6 7 |
| Melodic Minor | W H W W W W H | C D Eb F G A B C | R 2 iii 4 5 6 7 |
| Harmonic Minor | W H W W H 1.5 | C D Eb F G Ab B C | R 2 iii 4 5 vi 7 |
| Pentatonic Major | W 1.5 W W 1.5 | C D F G A C | R 2 4 5 6 |
| Pentatonic Minor | 1.5 W W 1.5 W | A C D E G A (relative to C) | R iii 4 5 vii |
| Blues Scale | 1.5 W H H 1.5 W | A C D Eb E G A (relative to C) | R iii 4 v 5 vii |
| Whole Tone | W W W W W W | C D E G Ab Bb C | R 2 3 v vi vii |

Fig. 11

Please Note: in music a 9th note is a 2nd note that has been raised one octave / 11 = 4 / 13 = 6
Notes in parenthesis are optional.

| Chord Name & Spelling | Type E Pattern 1E | Type G Pattern 4E | Type A Pattern 1A | Type C Pattern 4A | Type D Pattern 1D |
|---|---|---|---|---|---|
| **Major Chords** | | | | | |
| **Major (M)** R, 3, 5 | R-5-R-3-5-R | R-3-5-R-3-R | X-R-5-R-3-5 | X-R-3-5-R-3 | X-X-R-5-R-3 |
| **aug** R, 3, #5 | 3-vi-R-3-vi-R | Use Type E | X-X-vi-R-3-vi | vi-R-3-vi-R-3 | X-X-3-vi-R-3 |
| **6** R, 3, (5), 6 | R-5-R-3-6-R | R-3-5-R-3-6 | X-R-5-R-3-6 | X-R-3-6-R-3 | Use Type C |
| **6/9** R, 3, (5), 6, 9 | R-5-X-3-6-2 | Use Type A | X-2-5-R-3-6 | Use Type D | X-6-2-5-R-3 |
| **add 9** R, 3, (5), 9 | R-5-2-3-5-R | R-3-5-2-X-X | X-2-5-R-3-5 | 3-R-2-5-R-3 | 2-5-R-5-R-3 |
| **Minor Chords** | | | | | |
| **minor (m)** R, iii, 5 | R-5-R-iii-5-R | R-iii-5-R-5-R | X-R-5-R-iii-5 | X-R-iii-5-R-X | X-X-R-5-R-iii |
| **dim** R, iii, v | R-v-R-iii-X-v | X-R-v-R-iii-X | X-R-v-R-iii-X | v-R-iii-X-R-v | X-X-R-v-R-ii |
| **dim7** R, iii, v-6 | R-v-R-iii-6-R | 6-iii-6-R-v-6 | X-R-v-R-iii-6 | X-R-iii-6-R-v | X-X-R-v-6-iii |
| **m6** R, iii, (5), 6 | R-5-R-iii-6-R | R-iii-5-R-5-6 | X-R-5-R-iii-6 | X-R-iii-6-R-X | X-X-R-5-6-iii |
| **Seventh Chords** | | | | | |
| **7** R, 3, (5), vii | R-5-vii-3-vii-R | R-3-5-R-3-vii | X-R-5-vii-3-5 | X-R-3-vii-R-3 | X-X-R-5-vii-3 |
| **7 sus4** R, 4, (5), vii | R-5-vii-4-5-R | R-4-vii-R-4-vii | X-R-5-vii-4-5 | X-R-4-vii-R-4 | X-X-R-5-vii-4 |
| **9** R, 3, (5), vii, 9 | R-5-vii-3-5-2 | R-X-vii-3-2 | Use Type G | X-R-3-vii-2-5 | Use Type C |
| **11** R, 3, (5), vii, (9), 11 | Not Available | R-X-vii-9-4 | X-R-4-vii-2-5 | X-R-X-vii-2-4 | Use Type C |
| **13** R, 3, (5), vii, 13 | R-5-vii-3-6-R | R-X-vii-R-3-6 | X-R-5-vii-3-6 | X-3-vii-2-6 | Use Type C |

Fig. 12

| Name and Symbol of Interval | Aural Effects | | Name of Interval | Aural Effects |
|---|---|---|---|---|
| Root Note R Repetition | open consonance, stable, repetition | | Perfect Fifth 5 Twinkle Twinkle | open consonance, stable |
| Minor Second ii | sharp dissonance, unstable, edgy, clashing | | Aug Fifth or Minor Sixth vi | soft consonance, wide, blended, a bit unstable |
| Major Second 2 Happy Birthday | mild dissonance, unstable, smooth, connected | | Major Sixth Dim Seventh 6 My Bonnie | soft consonance, wide, pleasant, a bit unstable |
| Minor Third iii | soft consonance, a bit unstable, dark, sad | | Minor Seventh vii | mild dissonance, unstable, wide, some edge |
| Major Third 3 When the Saints | soft consonance, bright, euphonious | | Major Seventh 7 Rarely Used | sharp dissonance, unstable, edge, clash |
| Perfect Fourth 4 Here comes the bride | varies depending on how it is used | | Octave 8 Somewhere Over the Rainbow | open consonance, stable, firm |
| Aug Fourth or Dim Fifth iv | neutral or restless, unstable, tense | | | |

FRET RUNNER

This application claims priority from provisional application Ser. No. 61/209,858 filed on Mar. 12, 2009

CROSS-REFERENCE TO RELATED APPLICATIONS

None

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISC APPENDIX

Not applicable

SEQUENCE LISTING

Not applicable

BACKGROUND OF INVENTION

1. Field of the Invention

This invention relates generally to musical education and more specifically to a musical notation system that greatly simplifies the process of mastering any musical instrument. The examples presented here focus on the guitar but can be applied to many other instruments including the human voice.

2. Description of the Prior Art

The guitar is a remarkably simple instrument for beginners. It doesn't take much effort to learn a few chords and with those under your belt you can play a wide assortment of popular songs. That's good enough for many players, but if you wish to dig deeper the guitar can present bigger and better challenges for a lifetime.

For too many years, however, guitar instruction has been approached haphazardly. You pick up a little here and there, and with years of dedication you might eventually become good. Or like many players you might spin your wheels and fail to progress. Not for a lack of talent or dedication, but rather because you simply don't know what you need to do to get better.

To a large degree music programs such as those offered by GIT (Guitar Institute of Technology in Hollywood Calif.) have solved the problem by offering excellent courses. And those who have the opportunity should take advantage of them. But not everyone has the time and money to do that.

For those relying on the written instruction available it's a different ball game. Some things are explained in so much detail that the meaning becomes buried; other things are left out entirely. Authors assume knowledge that the particular student may not have. Or they repeat information seen many times before. Students are forced to go from one book to another, hunting for tidbits, because no single source has laid it all out for them—until now.

This invention bridges two patent subclasses. The first subclass is 483.2 musical notation systems. More specifically the use of colorized notation as it pertains to musical instruments. The second subclass is 471SR musical slide rules. We will examine prior art in these two areas separately. However it is the contention of the inventor that by combining both concepts into one idea an unexpected synergism is created that greatly exceeds the sum of the two. And when further enhanced with mnemonic notation, the Scale Degree Board, and other proprietary features and methodologies the new result has many more capabilities than the prior art.

Musical Notation Systems

An aid to note identification is found in U.S. Pat. No. 6,218,603 to Coonce (2001) entitled "Note locator for stringed musical instruments". While useful, this device requires colored stickers, which must be affixed to the musical instrument. The student is then forced to look constantly to the fretboard while reading the musical notation. Most teachers firmly believe that looking at the fretboard while reading music is an error, thus the device instills poor study habits. The student is further required to learn each separate color used to identify a note without the benefit of mnemonic word associations to aid the memory. These problems are equally inherent to U.S. Pat. No. 5,945,618 to Bennett (1999) wherein the inventor has substituted an actual guitar neck with a colorized fretboard in place of the stickers. This device is further undesirable in that any instrument with such a fretboard will always be perceived as a "crutch" because the colors are not removable as in the "Note Locator" device.

Experiments in Color Notation

Wikipedia.Com reports a related study conducted by Dr. George L. Rogers, the Director of Music Education at the Westfield State College Mass. An experimental group used color-coded method books and supplementary materials in which each different pitch was highlighted with a different color using felt-tip markers. The control group used identical materials, but with the notation uncolored. After the 12 week instructional period subjects in the experimental and control group performed much the same when playing a 26 note melody from memory. However, the students who learned using color-coded notation scored significantly lower when sight-reading plain notation.

Similar results were found when students named the letter names of the notes in two 7-note melodies. A possible theory is that the students in the experimental group memorized the colors instead of the notation. The color-coded materials had a positive affective influence in that 65% of all subjects favored the color-coded notation as easier to play. As a result of these experiments, colored notation does seem to help early music students to learn notation and rhythms more than students with uncolored notation.

In Rogers' 1991 study of color-coded notation, it is clear that students relied more heavily on the colors that were assigned to the notation, rather than on learning the notation. However, as the students were able to easily tell the different notes apart, Rogers theorized, perhaps by using different colors that are not assigned to a note, the experimental students would have been able to read not only the colored notation better but also the uncolored notation. Dr. Rogers did change the second study, in 1996, making the colors arbitrary. While the "obvious disadvantage of memorization" from the 1991 study exists, the overall findings of the study were that colored musical notation is an inexpensive and effective tool when used with young music students. However, there is no indication that Dr. Rogers' ever considered using mnemonics with colorized notation to overcome the "obvious disadvantage of memorization". Nor that his colored notation ever took the form of a musical slide rule.

Musical Slide Rules

We turn now to musical slide rules. An early but interesting embodiment is presented in U.S. Pat. No. 4,069,737 to Andersson (1978). Here the inventor uses a slide rule device to convert standard musical notation into a format more like tablature. He grasps the idea of using a slide rule for the purpose and even worked out a Major scale pattern of window apertures through which the named letters of the chromatic scale can be viewed as they appear on a second sliding element. And if all a user wanted was to convert notation this would be sufficient. But he repeatedly states that the notes are to be identified by letter only and never considers the use of colors for the purpose. He never intends for standard notation to be readable without the intermittent step of converting to another format. Most importantly he also completely omits any reference to intervallic relationships. And even his apertures fall short of optimal design since he has chosen to use small dotted windows. Dots were rejected during the development of the new invention because they are not as easy to read as the new design. Andersson specifies that the device is to be used for fretted instruments only whereas the new invention works for the human voice and indeed any instrument other than percussion.

Further this prior art has, for whatever reason, proven commercially unsuccessful. The only way someone is likely to find out about it is from a patent search because the device exists nowhere in the market place.

In fact the only musical slide rule to have demonstrated any marketability is U.S. Pat. No. 5,386,757 to Derrick (1995), which does have some online presence although it does not seem to be available in stores. This is unfortunate because some of the old slide rules are useful items even though they lack many of the features and benefits of the new invention.

It is difficult to say if the lack of market penetration has been the result of design limitations, failure of the patent holders to actively pursue sales, or hierarchical resistance to the new ideas. However music students have been crying out for centuries for a simplified means of communication. In fact the vast majority give up in frustration long before they achieve their true potential in the field. Jazz great and founder of the Guitar Institute of Technology in Hollywood Calif., Howard Roberts, once said, "Students often blame themselves for not having enough talent. It's not that they don't have the talent; they just don't know where their fingers are supposed to go." With the new invention that problem is at long last solved.

Given the fact that it's been more than 30 years since U.S. Pat. No. 4,069,737 was issued one might be inclined to think that it's outdated. But it's actually very typical of even the most recent prior art. And all of the shortfalls mentioned in regards to it are still present in the field. And it's functionally limiting. Using dots instead of squares negatively affects readability and it's functionally limiting. Using letter names instead of colors, and in particular mnemonic colors, is functionally limiting. Omitting intervallic relationships is functionally limiting.

There are of course trade-offs and one must evaluate the full spectrum of options in order to determine the best possible manifestation of embodiments. Within the confines of this document we must narrow our focus. There simply isn't space to consider them all. Therefore the embodiments discussed should not be taken as the final decision on the matter. Here we merely seek an example for demonstration.

But in any event it is quite clear that the prior art does not take full advantage of the potential that is available. After 30 years one might think someone would have figured out what's missing. And from a backwards engineering viewpoint the new ideas may even seem simple. But in all these years no one has thought to do it until now. And after all, the idea is to make the musical education process as easy as possible particularly for young and beginning students.

U.S. Pat. No. 5,386,757 to Derrick (1995) introduces additional inefficient concepts. Colors are used for the sole purpose of indicating which finger should be used to play each note. Thus it actually teaches away from the more efficient use of colors. The device requires a "plurality of color-coded systems" which is not just unnecessary but also squanders a vital opportunity to teach how scales and chords are constructed and how they relate to each other. Further the text specifies that "These coding systems are used to isolate a maximum of five scale patterns for every twelve frets of fingerboard travel".

The new invention embodiment, as shown, describes up to seven interconnecting scale patterns for every twelve frets of fingerboard travel thus providing for smoother transitions between positions and greater fingerboard knowledge and requires only one overlay. It also provides for five basic overlaying chord fingering structures in each five-fret region of the fret board. A great many chord variations can be derived from each of them.

Many other examples of musical slide rules and, separately, colored musical notation can be found. However without properly combining the two concepts and without providing for the use of mnemonics, intervallic relationships, and additional exclusive features and methodologies that can be used by this variation of the new invention the prior art cannot hope to deliver the same benefits.

OBJECTS AND ADVANTAGES

Overview

It should be noted that other slide rules have used color to indicate which finger should be used for which note, or to differentiate one section of fretboard from another. The Color Board as depicted in this application is quite unique as are the numerous advantages of the depicted Scale Degree Board. When combined with the Multi-Fret Isolator, as shown, and when using exclusive methodologies such as mnemonics the new invention provides the user with an entirely new understanding and in depth knowledge of the structure and components of music and musical performance. And it does so with a clarity and simplicity wholly unimagined in the prior art. Even students with no prior training will quickly and easily grasp concepts and develop skills that would otherwise take many years of intense study to achieve.

This invention can include a system of musical notation that can be committed to memory almost instantaneously by using easily remembered word associations (mnemonics) with each musical tone. For example the "C" note can be associated with the color and term "canary yellow". Upon seeing any yellow-highlighted note in either standard written notation or in tablature, and regardless of key signatures, the student would know immediately that the "C" tone is to be played. A Color Board could then identify the exact locations of all "C" tones on any stringed musical instrument for the student to choose from. Further by using darkened shades of the appropriate colors "sharped" and "flatted" tones could be easily identified so the student need only learn 7 mnemonic terms instead of 12.

A special symbol could be provided on the Color Board so the student could easily tell which notes on which strings fall into a particular octave range. For example an identical "D" tone can be found on the "E" string at the $10^{th}$ fret, on the "A" string at the $5^{th}$ fret or played in the "open" position on the "D" string. The student could then choose the option that provides the optimal fingering position or possesses other desired qualities such as an open tone with more "ring" or a heavier string with a "thicker" tone.

The entire process can be learned about as quickly as it takes to read about it. It also resolves the previously mentioned problem in other color systems where the students remember the color of a note instead of the name of a note. It's a very simple matter to teach the student to remember "C is for "canary". This is just as helpful for adult students as it is for younger ones. If the student can recall the color for the line or space in standard notation the letter name of the note would instantly come to mind. And should a student desire to play the instrument in an altered tuning, for example when playing slide guitar, the Color Board could be instantly replaced with an altered pattern that will achieve the same advantages with no additional training required. However once the correct Color Board is selected for a particular tuning it need not be changed for any reason until a different tuning is desired. This is true for all tuning options.

A second component can take the form of a Scale Degree Board. Perhaps the best way to introduce this feature is by recalling an old episode of a comedy TV show. I think it was "Family Ties". One of the characters was trying to impress a girl by bragging about his guitar playing abilities. She asked him, "How many chords do you know?" He replied, "All of them." And then the laugh track plays to let everyone know it's a joke. There are thousands of ways to play a chord on a guitar. Nobody could possibly know "all" of them—until now.

And not just the chords. This system can teach every possible scale as well. And in every possible position. The most commonly used scales (the Major and minor pentatonics, as well as the blues scale, along with all 7 modes) can be prominently displayed and require little or no additional information to use. Any remaining scales or chord spellings, no matter how exotic, can be easily determined by simply knowing the correct "spelling" for them and "dialing them in" in much the same way one would use a touch tone pad on a telephone to "dial" a number. This system can make it abundantly clear which chords go with which musical scales, and even explains why in terms simple enough that even a beginning student can understand it. That has always been a mystery to even advanced players.

In fact if the user knows what musical characteristics or emotions he would like to add to a composition those can be "dialed in" as well. For example, if a composer wanted to change from a happy feeling to a sad one he would simply lower the $3^{rd}$ degree one half step to a flatted third (iii) thus changing from a Major chord to a minor chord.

Most players are aware of that but only a few know that there are similar recognizable emotions related to each of the 12 tone intervals in the chromatic scale. Any of these emotions can be added (or even "hammered on" Van Halen style) to a composition at any point desired if the composer has enough knowledge to do so. This invention can make that very simple. And it can do so without ever having to change the Scale Degree Board. However, as with the Color Board, if a student desires to play the instrument in an altered tuning, for example when playing slide guitar the Scale Degree Board can be instantly replaced with an altered pattern that will achieve the same advantages with no additional training required. However once the correct Scale Degree Board is selected for a particular tuning it need not be changed for any reason until a different tuning is desired. This is true for all tuning options.

A slide rule that provides so much information, at a glance, could be confusing. Therefore it is advantageous that we can provide a means of helping the user focus on just the information that is needed for the immediate goal of playing a chord or a scale or creating a particular passage of music. A third element, a Multi-Fret Isolator would do just that. The Multi-Fret Isolator blocks the currently unnecessary information from view and allows the user to focus on specific multi-fret sections of the multiple strings of the instrument which the human hand can grasp without moving from position. The student could then identify tone patterns within that section and associate them with scale patterns or fingerings so as to create the desired scale or chords or perform musical passages. Other systems go to a lot of trouble telling the user which finger to use for which note. With the Multi-Fret Isolator there's never a doubt. The rule is each of the four fingers gets its own fret and plays all of the notes on that fret. The first and fourth finger can stretch to play an additional fret at either the top or bottom of the four fret section depending on whether the performer is moving up or down the neck.

In addition the student can learn the intervallic relationship of each note in the multi-fret section as it compares with every other note in the multi-fret section. The student would then be able to compare any multi-fret section with each of the six other multi-fret sections along the neck; by doing so the student can learn to completely "Master" the instrument.

The slide rule as described could be attached to the music sheet or be placed just above or beside it requiring the student to keep his focus in the general area. The student would match the indicated movements on the instrument tactually and aurally, rather than visually. This would provide for better study habits. While providing an exhaustive selection of scales and chords such a visual aid, in this embodiment, could easily be slipped into a musical instrument case or even a shirt pocket and would require no electricity. It could be easily adapted for left-handed players. An embodiment could be used to teach non-string instruments of all types since the full spectrum of musical knowledge can be thereby presented. Such a device could even simplify the process of composition for a full orchestra or any part thereof. Such a device could also be used for transposing between musical keys or modes or to convert standard music notation into tablature notation and vice versa. Still further objects and advantages will become apparent from a consideration of the ensuing description and drawings.

In conclusion there is a very long history of using color in a musical notation system. In fact it dates back to the very beginnings of written music. And musical slide rules have been around in various forms for decades. However, by combining the best elements of both an unexpected synergism can be created that exponentially exceeds the sum of the parts. And when further enhanced with the application of mnemonics and the logic of a Scale Degree Board along with other proprietary features and methods the full potential of a music notation system can at long last be achieved.

BRIEF SUMMARY OF THE INVENTION

In accordance with the present invention a colorized musical notation system can be embodied in the form of a musical slide rule or other computer and can include methods of enhancing standard musical notation, guitar-type tablature, or other written musical notation to increase readability. Mnemonic color names can be included to aid the user's memory. Scale Degree Indicators can be included for computing musical scales, chords, and passages. Standard musical notation as well as tablature can be mnemonically enhanced. These elements can be used separately or combined in various configurations to provide the optimum benefit for any particular situation.

BRIEF DESCRIPTION OF THE SEVERAL VIEWS OF THE DRAWING

FIG. 8 is a table or chart showing one possible expression of mnemonic color names that could be used to enhance the user's ability to identify notes on a musical slide rule or other computer in addition to an enhanced form of written musical notation.

FIG. 9 is a table or chart listing the seven musical modes used in American and Western European music of various types. It gives examples of how each mode can be used along with their scale patterns, the spelling of the mode in the key of C, and their intervallic spelling patterns.

FIG. 10 is a table or chart listing additional scales commonly used in American and Western European music. It includes their scale patterns, the spelling of each mode in the key of C, and their intervallic spelling patterns.

FIG. 11 is a table or chart listing chords commonly used in American and Western European music. It includes their intervallic spelling patterns and instructions on how they can be executed in five different bar chord shapes.

FIG. 12 is a table or chart listing the aural or psychological effects of hearing the interrelation of any two musical notes. Examples of the interval are provided along with the symbol of each interval. Please note that the symbols as shown use a white text with a black background in accordance with the USPTO rule that states "Solid black shading areas are not permitted, except when used to represent bar graphs or color." In this document black shading always represents a color.

Figure 1:
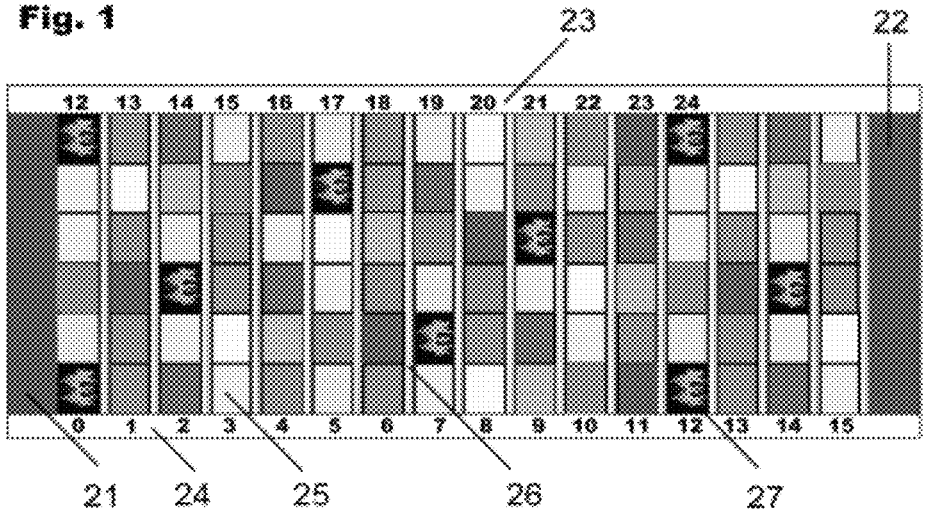
FIG. 1 is a plan view of an embodiment of the Color Board alignable insert.
Figure 2:
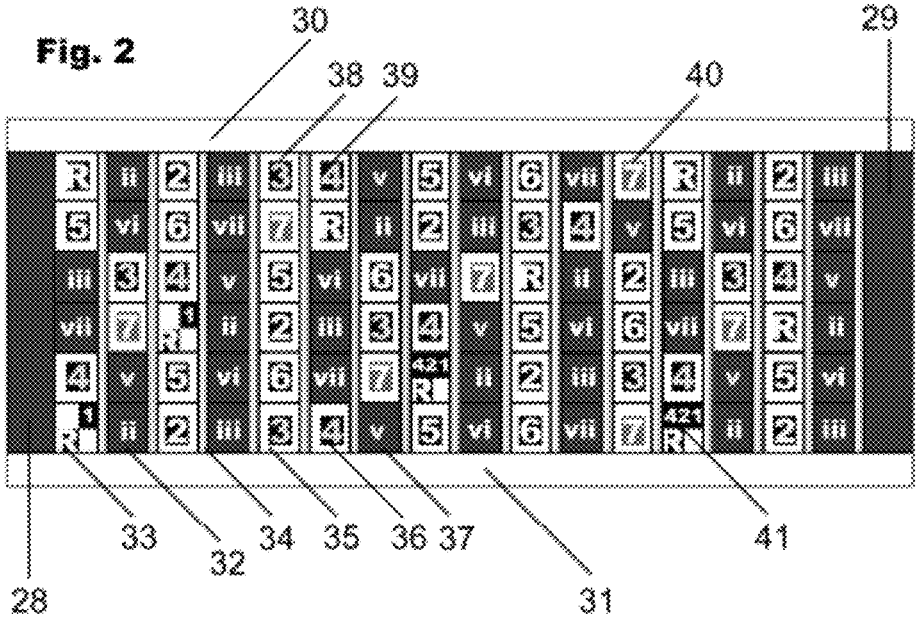
FIG. 2 is a plan view of an embodiment of the Scale Degree Board alignable insert.
Figure 3:
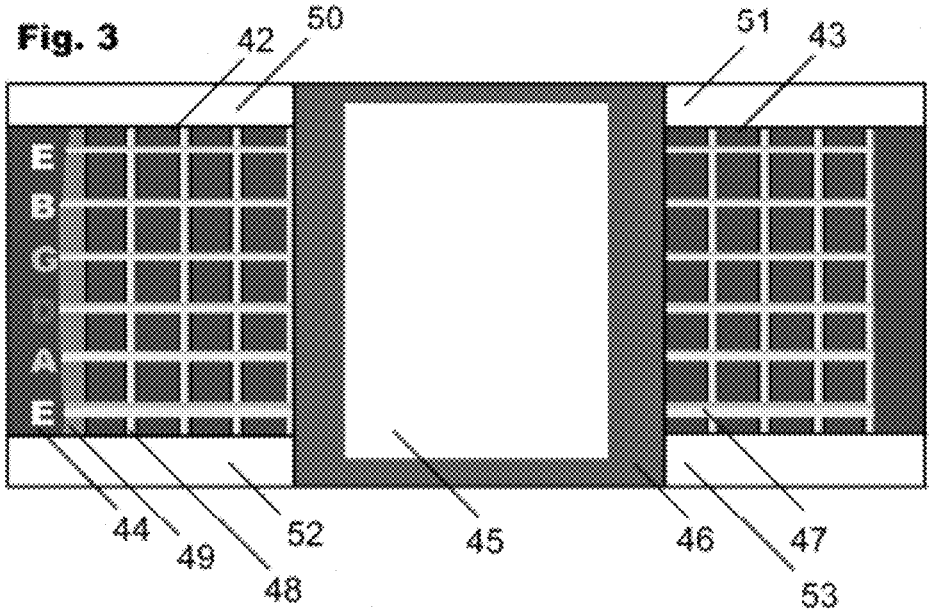
FIG. 3 is a plan view of an embodiment of the Multi-Fret Isolator viewing sleeve.
Figure 4:
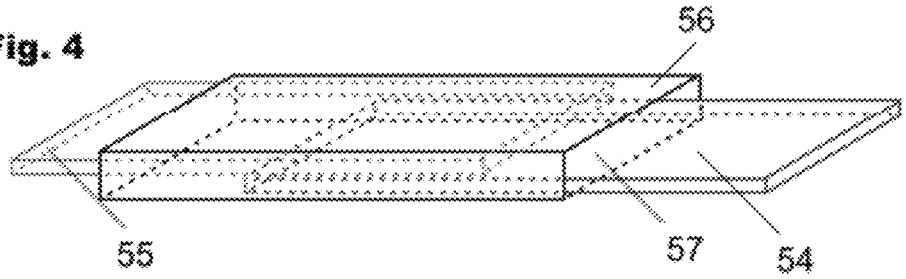
FIG. 4 is a perspective view showing an embodiment of the Color Board alignable insert FIG. 1 as affixed to a base 54 and the Scale Degree Board alignable insert FIG. 2 as affixed to a base 55 as they might be inserted into the Multi-Fret Isolator viewing sleeve FIG. 3 as affixed to a base 56. Please note that the reference numbers 54, 55, and 56 refer only to the base objects that the designs in FIGS. 1, 2, and 3 are affixed to. They are not a second number for the same item. They are shown only to indicate that the slide insert designs can indeed go on some things and to illustrate how said things can be assembled.

| DRAWINGS List of Reference Numbers | |
|---|---|
| FIG. 1 Color Board | |
| 21 | left alignment grip |
| 22 | right alignment grip |
| 23 | upper frets identifier |
| 24 | lower frets identifier |
| 25 | color cell array |
| 26 | fret wire grid |
| 27 | octave indicators |
| FIG. 2 Scale Degree Board | |
| 28 | left alignment grip |
| 29 | right alignment grip |
| 30 | top alignment strip |
| 31 | bottom alignment strip |
| 32 | altered scale degree indicator |
| 33 | root note key |
| 34 | fret wire grid |
| 35 | note identification window array |
| 36 | scale degree identifier array |
| 37 | blue note indicator |
| 38 | third degree indicator |
| 39 | fourth degree indicator |
| 40 | seventh degree indicator |
| 41 | hand position guide |
| FIG. 3 Multi-Fret Isolator | |
| 42 | left window screen |
| 43 | right window screen |
| 44 | open note identifiers |
| 45 | view window |
| 46 | view window frame |
| 47 | string grid |
| 48 | fret wire grid |
| 49 | nut |
| 50 | upper left cut away |
| 51 | upper right cut away |
| 52 | lower left cut away |
| 53 | lower right cut away |
| FIG. 4 Assembly | |
| 54 | Color Board base |
| 55 | Scale Degree Board base |
| 56 | Multi-Fret Isolator |
| 57 | Multi-Fret Isolator insertion channel |

Please note that the reference numbers 54, 55, and 56 refer only to the base objects that the designs in FIGS. 1, 2, and 3 are affixed to. They are not a second number for the same item. They are shown to indicate that the designs can indeed go on some things and to illustrate how said things can be assembled.

DETAILED DESCRIPTION OF THE INVENTION

Embodiment as Shown in FIGS. 1 Through 12

The images and descriptions below represent only one possible embodiment of the invention. Accordingly, the scope of the invention should be determined not by the embodiment (s) illustrated or by their description(s), but by the appended claims and their legal equivalents.

The Color Board

FIG. 1 shows a plan view of an alignable insert referred to in this document as the Color Board. As shown the Color Board is comprised of seven (7) features or elements which are printed or otherwise displayed on a base 54 of plastic, wood, ceramic or other suitable material. In the depicted embodiment the length and width of the base are equal to the length and width of a second alignable insert as shown in FIG. 2. The flexibility and thickness of the base is a question of aesthetics rather than function except that the device must be strong enough to hold up to its intended use. Thus the base could be laminated paper or a heavier material. In any event a thin layer of plastic, paint, varnish or other clear material can be used to protect a printed pattern from wearing off from said use. It is desirable that the base itself be dark brown in color with a wood grain pattern resembling rosewood.

The Printed Color Board Pattern

Alignment grips 21 and 22 can be provided at the left and right ends of the color board to facilitate manipulation. They can extend vertically between the upper and lower fret identifiers 23 and 24 but their width is determined by aesthetics rather than function. The alignment grips would preferably be dark brown in color with a wood grain pattern resembling rosewood.

Between the alignment grips is an array or pattern of color cells 25. As shown the color cell array has 16 columns of specifically colored cells. The number of rows of colored cells is equal to the number of strings on the particular musical instrument the device is to be used to teach. In FIG. 1 there are six rows of color cells because there are six strings on a guitar. An embodiment used for a four string bass guitar, however, can have four rows of color cells. The color of each cell in the color cell array corresponds to the musical note that would be found on the corresponding string at the corresponding fret of said musical instrument as indicated by FIG. 8. It is recommended that each color cell be identical in size and that they be evenly spaced. As shown the color cells are each one-half inch square minus the width of one fret wire 26.

Shown between each column of color cells is a fret wire known collectively as the fret wire grid 26. Fret wires can extend vertically between the upper and lower fret identifiers 23 and 24. Their suggested width is roughly proportional to the width of fret wires on a fretted musical instrument such as a guitar. It is desirable that they be gold or silver in color.

Frets identifiers 23 and 24 can be provided along the upper and lower sides of the Color Board. Both identifiers could consist of a white strip running the full width of the Color Board. Here both identifiers show a series of black numbers with each centered under or above each column of color cells. As shown the numbers of both fret identifiers increase sequentially from left to right. The lower fret identifier begins with the number zero (0) and ends with the number fifteen (15). The upper fret identifier begins with the number twelve (12) and ends at the column identified as twenty-four (24). Please observe that the color cell pattern repeats at column 12. (Looking only at the lower fret identifier compare column 12 with column 0, 13 with 1, 14 with 2, and 15 with 3.) Thus the columns indicated as 12 or above on the lower fret identifier can represent the exact same columns as their corresponding numbers in the upper fret identifier.

Specialized symbols known as octave indicators 27 are shown in the color cells that correspond with the repetitions of the lowest note found on the musical instrument in question. In standard guitar tuning the lowest note that can be found is an E. Therefore the specialized symbols occur at the cells indicated as 0, 12 and 24 on the lowest and highest rows of color cells. They would also occur on the second lowest row of color cells on the column marked 7 or 19, on the third row from the bottom on columns marked 2 or 14 (please recall that there are two representations of column 14), on the fourth row from the bottom on the column marked as 9 or 21, and on the fifth row from the bottom at the column marked as 5 or 17. These locations would, of course, change in the event that we choose to use an altered tuning.

Note: an alternate embodiment can depict the Color Board as being a full 24 frets (columns) long. This would simplify the operation. However it would require a larger and less portable device. Both versions are equally valid. In this case the choice was made primarily to accommodate the page size of the patent art. A Color Board can be other lengths but those are the two logical choices.

The Scale Degree Board

FIG. 2 shows a plan view of one possible embodiment of an alignable insert hereafter referred to as the Scale Degree Board. As shown the Scale Degree Board is comprised of fourteen (14) features or elements which are printed or otherwise displayed on a base 55. The length and width of the base can vary however it should be of sufficient size that the pattern of alpha numeric or other symbols can be displayed legibly. As shown the note identification windows 35 on which the alpha-numeric pattern 36 (scale degree identifier array) appears were laid out in one-half inch squares generally resulting in alpha-numeric figures of roughly one-quarter inch in size. This resulted in a width of nine inches and a height of three and one-half inches. The material, flexibility, and thickness of the base 55 can be the same as the Color Board described above. However it can be transparent. And like the Color Board it is desirable that the alpha-numeric pattern and other design elements be covered with a thin layer of clear protective material to guard against wear.

The Scale Degree Pattern

Alignment grips 28 and 29 are provided at the left and right ends of the Scale Degree Board FIG. 2 to facilitate manipulation. They can be identical to the alignment grips described in FIG. 1. Alignment strips 30 and 31 are provided at the top and bottom of the board. These can be the same dimension as those in FIG. 1. However they can be transparent and can have no markings whatsoever. Thus the FIG. 1 alignment strips 23 and 24 can be clearly viewed when the Color Board is placed behind the Scale Degree Board.

A fret wire grid 34 identical in every way to 26 can be provided. A note identification window array 35 dimensionally identical to the color cell array 25 can also be provided. Each row of windows 35 corresponds to a string on a musical instrument, in this case a 6 string guitar, as though it were laid out flat in front of the viewer. Anyone familiar with tablature should readily understand this.

We will say that some cells or apertures of the note identification window array 35 are "open" and that others are "closed". The open windows correspond with the Major Scale Pattern beginning with an open window in the leftmost column of the lowest row of windows with each adjacent window in a row being regarded as one half-step. The Major Scale Pattern is rudimentary knowledge for trained musicians thus the pattern here is quite easily determined. Those unfamiliar with this pattern should simply refer to FIG. 2. Since the Scale Degree Board pattern in FIG. 2 is designed to repeat it can begin anywhere in the pattern. However it is most logical that it begin with the lowest note in the first finger lowest (by tone) string position referred to in FIG. 11 as position 1E.

The closed windows correspond to the altered degree notes of the Major scale. Altered degree notes are those that fall between the Major scale notes. Major scale notes can be referred to as natural notes. Each closed window cell is filled with an altered scale degree indicator 32. As shown in FIG. 2 each altered scale degree indicator 32 has a colored background which can match the alignment grips being dark brown with a wood grain pattern resembling rosewood.

A lower case Roman numeral identifying the altered scale degree FIG. 12 found in the corresponding position of the instrument being studied can be centered in each cell. The lower case number indicates that it is the flatted note of the note that follows it going up the scale. For example the symbol iii could be used in the flatted third note position. With the sole exception of the flatted fifth symbol, v, these symbols can be white in color. The flatted fifth symbol, v, should be blue in color and can be referred to as a blue note indicator 37.

The open windows correspond to the degrees of the Major scale. Each open window has a clear background such that when the Color Board FIG. 1 is placed behind the Scale Degree Board FIG. 2 the corresponding color of the Color Board cell can be visible through the transparent portion of the window 35.

A scale degree identifier 36 can be centered in each transparent window cell. Scale degree identifiers 36 can be composed of an Arabic number or other symbol against a contrasting background. The number or symbol used in each case indicates the numeric name of the Major scale degree FIG. 12 of the corresponding musical note found in that position on the actual instrument.

Other symbols such as the letter R can be used to indicate special characteristics. The letter R in this case indicates the various locations of the Root note in the pattern and can be referred to as the root note key 33. Generally the number or symbol of the scale degree identifier 36 can be white in color however special characteristics can be indicated by the use of other colors. The color green, for example, is used here as a third (3) degree indicator 38. The color amber is used here as a fourth (4) degree indicator 39. Generally the background color of the scale degree identifier can be black however special characteristics can be indicated by the use of other colors. A red background is used here as a seventh (7) degree indicator 40.

Additional information can be communicated by using further alpha numeric elements or other symbols. In this case a hand position guide 41 is provided. Hand position guides can appear in window cells of certain root note keys. The diagram shows two different types. The first type has only one number or symbol generally a number one (1). The second type has three numbers or symbols in this case the numbers 4, 2, and 1. In either case the numbers or symbols can be white in color and appear against a contrasting background generally black.

The Multi-Fret Isolator

FIG. 3 shows a plan view of one possible embodiment of a slide rule sleeve or guide referred to in this document as the Multi-Fret Isolator. As shown the Multi-Fret Isolator has twelve (12) features or elements which are printed or otherwise displayed on a sleeve or guide component. The dimensions and features of the component itself will be discussed in FIG. 4. Window screens 42 and 43 can be provided on the left and right sides of the view window frame 46.

As shown the widths of the window screens (42 and 43) are such that when both are added to the width of the window frame 46 the total is equal to the width of the Color Board FIG. 1. However the left window screen 42 can extend an additional quarter inch (0.25") to allow fitment of open fret identifiers 44.

The height and position of the window screens 42 and 43 are such that both the top and bottom alignment strips 23 and 24 of the Color Board FIG. 1 can be viewed when the Color Board is in the operable position. See FIG. 4 and FIG. 5 if this is unclear. The height of the window screens 42 and 43 can therefore be equal to the height of the color board minus the combined height of the top and bottom alignment strips 23 and 24. The window screens can be dark brown in color with a wood grain pattern resembling rosewood so as to match the other components FIG. 1 and FIG. 2.

In FIG. 3 a fret wire grid 48 is displayed across both window screens. This grid is spaced identically to the grids in the other two components such that when the device is assembled all three grids can be exactly aligned one atop another. Four (4) fret wires 48 are suggested for each window screen including one butted directly to the left side of the view window frame 46.

As shown this leaves a space of 1.25" on the left window screen 42 to the left of the fret wire grid 48. The leftmost quarter inch (0.25") can be left unmarked. The next quarter inch to the right (0.25" to 0.5" from the edge) can include open note identifiers 44.

Open note identifiers identify the letter names of the musical notes that are sounded when the string that corresponds to the row each letter resides next to is played open (not fretted). As shown there is one letter-name identifier per row of FIG. 1 color cells which is to say one letter per string of the musical instrument in consideration. Said letter names can include sharp or flat symbols in the event they are required. And they can be shown in the color that is assigned to the tone they represent. White can be substituted for the color black to increase contrast if that will improve visibility. Contrasting backgrounds can also be provided. Please note that when open note identifiers 44 are included with an embodiment of the Multi-Fret Isolator FIG. 3 said Isolator can need to be changed when changing to an altered tuning. Otherwise a means of temporary attachment can be provided.

Shown in the quarter inch to the right of the open note identifiers 44 is a nut 49. The nut is designed in the image of the nut on the neck of a guitar and it resides in the location where a fifth (5th) fret wire might otherwise occur. However it can extend a quarter inch to the left thus being somewhat wider than a fret wire. It can extend the full height of the window screen.

Clear viewing windows known as "cut aways" 50, 51, 52, and 53 can be provided in the upper left and right corners and the lower left and right corners to allow viewing of the upper and lower frets identifiers 23 and 24 when they are inserted into the Multi-Fret Isolator channel 57. These viewing windows can be made of a transparent material such as plastic or glass. Alternately these areas can simply be cut out and removed from the Multi-Fret Isolator cutting through the sides and bottom of those portions as well. This would have the added benefit of allowing easier access when adjusting the Color Board FIG. 1 and Scale Degree Board FIG. 2 in relation to the view window 45. It would perhaps require that the materials of the Multi-Fret isolator be made a little sturdier since the top and bottom would then only be held together by the sides of the view window frame 46. In another embodiment cut aways are not included meaning that the upper and lower fret identifiers are only visible as they pass behind the view window 45 or extend from the Multi-Fret Isolator insertion channel 57.

Figure 5:
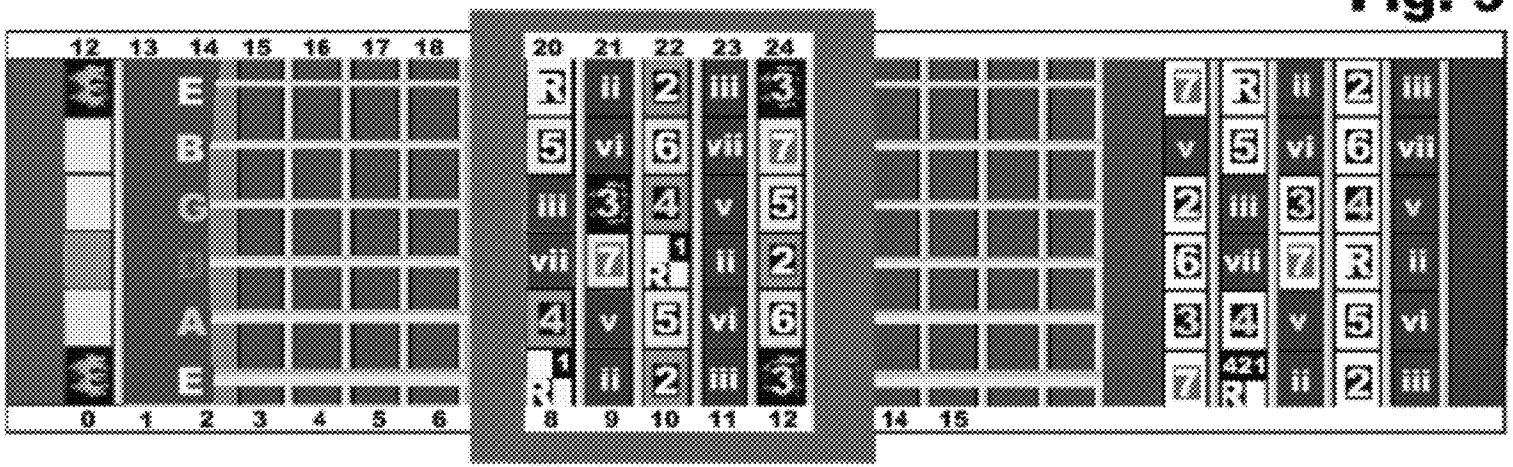
FIG. 5 is a plan view showing an embodiment of the Color Board alignable insert FIG. 1 as affixed to a base 54 and the Scale Degree Board alignable insert FIG. 2 as affixed to a base 55 as they might be inserted into the Multi-Fret Isolator viewing sleeve FIG. 3 as affixed to a base 56. The elements are not numbered because all of its parts have been previously described and identified. Due to the fact that some parts are clear with other parts showing behind them numbering this diagram would only confuse the viewer. Please refer to FIGS. 1 through 4 when referencing this image.

Reference number 47 identifies a string grid beginning at the left side of the nut and extending to the window frame 46. The string grid resumes immediately after the window frame and terminates immediately after crossing the last fret wire on the right. The number of strings in the grid is determined by the number of strings located on the musical instrument being considered. The strings can be laid out in tablature order such that when the device is assembled FIG. 4 the thickest string will be centered with the lowest row of color cells as shown in FIG. 5. The remaining strings can be centered one per row of color cells with each string getting progressively thinner as they ascend. The exact thickness of the strings is not significant except that they can convey a sense of relationship and proportion to the musical strings they are meant to represent.

FIG. 3 also shows a view window frame 46 located between the two window screens 42 and 43. As shown the width of the view window frame is equal to seven times the width of each color cell plus its associated fret wire. In this case that works out to 3.5 inches. The height of this view window frame is equal to the height of one color cell times the number of rows of color cells, plus four times the height of the lower fret identifier strip. It is desirable that it be colored in a brighter contrasting color or pattern to the window screens.

Centered in the view window frame 46 is a view window 45. The view window can be removed or cut out from the material used to construct the view window frame. Alternately a portion of the view window frame can be replaced with a transparent material such as clear plastic. In either event it is suggested that the width of the view window be five (5) times the width of one color cell plus the width of one fret wire, that is, 5×(A+B). The view window height can be equal to the total height of the Color Board.

FIG. 4 is a perspective view showing the fitment of the Color Board 54 and the Scale Degree Board 55 into the alignment channel 57 of the Multi-Fret Isolator 56. It should be clear that this view is not proportionate. More specifically the four sides of the Multi-Fret Isolator 56, though they are represented only by lines, would have actual thickness in the depicted embodiment. Said thickness is more a question of aesthetics than function except that it can be constructed of materials similar to the Color Board FIG. 1 and the Scale Degree Board FIG. 2 and must be strong enough to function in its intended use. It would be aesthetically pleasing that the non-printed sides of the isolator be black in color giving the device the overall appearance of a section of black guitar neck with rosewood frets.

As shown the Multi-Fret Isolator FIG. 3 is essentially a sleeve or hollow tube through which an alignment channel 57 passes thus allowing the Color Board 54 and Scale Degree Board 55 to be inserted, passed through, and aligned with the view window 45.

The design shown in FIG. 3 can be printed or otherwise displayed on either of the wider sides of the Multi-Fret Isolator. This would be the top side as shown in FIG. 4. It is desirable that inserts 54 and 55 fit snuggly in the alignment channel 57 though not so tightly as to impede their insertion and adjustment.

FIG. 5 shows a plan view of the assembly described in FIG. 4. The elements are not numbered because all of its parts have been previously described and identified. Due to the fact that some parts are clear with other parts showing behind them numbering this diagram would only confuse the viewer. Please consult FIGS. 1 though 4 for details. Please note that for this embodiment cut aways 50, 51, 52, and 53 have been removed.

Figure 6:
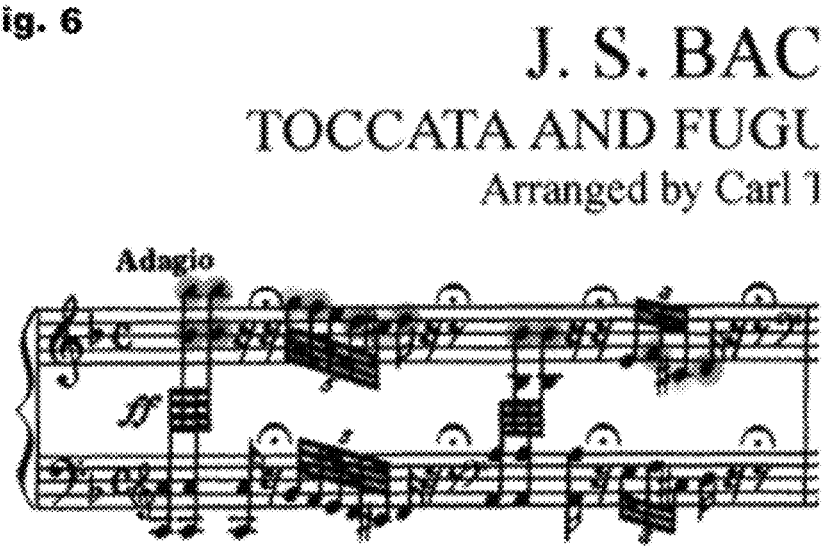
FIG. 6 is a reproduction of a segment of standard musical notation as it might appear with a portion mnemonically colorized in accordance with the new invention. The parts are not numbered because this type of notation is standard knowledge in the industry. The only change is that colors have been added in the manner of the invention.

FIG. 6 is a partially colorized version of standard musical notation. The parts are not numbered because this type of notation is standard knowledge in the industry. The only change is that colors have been added in the manner of the invention.

Figure 7:
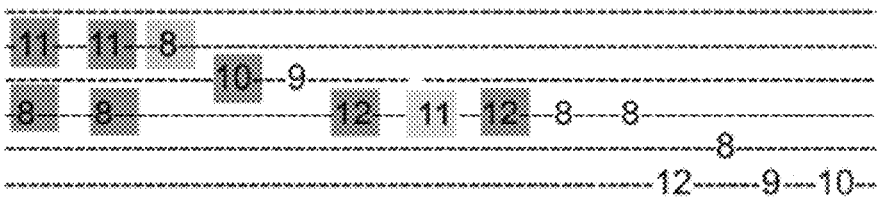
FIG. 7 depicts a segment of guitar type tablature as it as it might appear with a portion mnemonically colorized in accordance with the new invention. The parts are not numbered because this type of notation is standard knowledge in the industry. The only change is that colors have been added in the manner of the invention.

FIG. 7 is a partially colorized version of guitar tablature style musical notation. The parts are not numbered because this type of notation is standard knowledge in the industry. The only change is that colors have been added in the manner of the invention.

FIG. 8 is a table or chart showing one possible expression of mnemonic color names used to enhance the user's ability to identify notes on the musical slide rule or written musical notation.

FIG. 9 is a table or chart listing the seven musical modes used in American and Western European music of various types. It gives examples of how each mode can be used along with their scale patterns, the spelling of each mode in the key of C, and their intervallic spelling patterns.

FIG. 10 is a table or chart listing additional scales commonly used in American and Western European music. It includes their scale patterns, the spelling of the mode in the key of C, and their intervallic spelling patterns.

FIG. 11 is a table or chart listing chords commonly used in American and Western European music. It includes their intervallic spelling patterns and instructions on how they can be executed in five different bar chord shapes.

FIG. 12 is a table or chart listing the aural or psychological effects of hearing the interrelation of any two musical notes. Examples of the interval are provided along with the symbol of each interval. Please note that the symbol uses a white text with a black background in accordance with the USPTO rule that states "Solid black shading areas are not permitted, except when used to represent bar graphs or color." In this case the black represents a color.

OPERATION OF THE INVENTION

Operation for Embodiment as Shown in FIGS. 1 Through 12

The operations described below represent only one possible embodiment of the invention. Accordingly, the scope of the invention should be determined not by the embodiment(s) illustrated or by their description(s), but by the appended claims and their legal equivalents.

This embodiment of the color notation system is very simple in design but very powerful in function: it considers musical note patterns as they occur in specific sections of the multiple strings of a musical instrument. It can include a sleeve referred to in this document as a "Multi-Fret Isolator" FIG. 3 into which two patterned inserts FIG. 1 and FIG. 2 can be placed. The sleeve can be designed to conceal nearly all of the information on the inserts, except for a transparent view window 45 that can reveal a multi-fret section of selected information from either or both inserts simultaneously.

The user could use the inserts by themselves but more likely would prepare a device for use by placing both inserts into an alignment channel 57. For the purposes of this demonstration we'll say that the user would like to play the opening bar of J. S. Bach's Toccata and Fugue in D minor as shown in FIG. 6. We will discuss classical modes a bit later but for now suffice it to say that the D Dorian scale is equivalent to C Ionian. Therefore the user sets the device for C Major FIG. 5.

In this case the user would like the lowest C note in the sequence to occur on the lowest (thickest) string and he would like it to occur at his first (index) finger. He feels that this will be a good starting position giving him a good range of notes from which to choose. He therefore aligns the Scale Degree Board FIG. 2 so that the root note key 33 falls on that location in the view window 45. Next he aligns the Color Board FIG. 1 so that the proper color appears in the clear window of the root note key.

In one embodiment he checks an instruction booklet that came with the device and finds that the device uses a colorized notation system whereby certain colors are associated with words that begin with the letter of the note they are intended to represent FIG. 8.

Please note: the exact shade or tone of each color is irrelevant, except that each color should be easily distinguishable from the other notation colors used in the device. The color names can be chosen to aid the student in remembering which color corresponds with each note. The "Dark" colors can be significantly darker than their lighter counterparts (or otherwise differentiated) and the grays easily distinguished from the ebony.

Aligning the "Canary" Yellow color cell in the root note key results in FIG. 5. The user notices that all of the root note keys are now aligned with "Canary" yellow color cells. "C is for canary" he says with a grin. "How easy is that?"

In our scenario he clips the device to his music stand, or perhaps he uses Velcro, and settles into his seat ready to play some Bach. He looks at the piece of sheet music FIG. 6 his teacher has prepared by highlighting the notes he is to play. He knows the uncolored symbols mean he's supposed to rest. Having heard his teacher play the piece he knows how it's supposed to sound. He easily recognizes the name of each colored note then gives a puzzled glance at the uncolored notes on the bass clef.

Looking back at the opening notes on the G clef he's still a bit puzzled. He thought D Dorian being equal to C Ionian there would be no flats or sharps so why does the piece open with dark green notes? He looks at the key signature and notices that the B notes are all to be played flat. Well his teacher told him it was a very difficult piece. It's Bach. But he knows that B flat notes are the same as A sharp and finds the proper notes hidden behind the "vii" symbols FIG. 5. He knows which strings to play by looking at the string grid 47 and he knows which fingers to hold the notes down (fret) with because of the "One Finger Per Fret Rule".

Note: The "One Finger Per Fret Rule" simply states that each of the four fingers can be assigned to a particular fret and all the notes across that fret will be played by the same finger. An additional fret can be covered by either the first (index) finger or the fourth (pinky) finger depending on whether you are moving up or down the neck or depending on the playing position you are working with. More on that later. In this case our student is using the first finger on the first fret but a fifth fret can still be covered by the pinky finger.

With a little hunting and plucking our student easily completes the piece. And if the entire composition were so colored he could play it all. In fact he could play any composition by simply matching the colors on the sheet music to the appropriate note positions on the device then relating them to the notes on his guitar.

But for now he would like to try the piece in tablature. He simply aligns the fret numbers on the tablature FIG. 7 with the appropriate frets on the bottom alignment strip 31 resulting again in FIG. 5 and follows them in the same fashion. Please note that the last sequence of FIG. 7 has been left uncolored to stress the advantage of the colorized notation.

Before moving on let's observe a few more things. Notice that the piece FIG. 6 opens with two notes played simultaneously and both are dark "Apple" green meaning they are A sharp also known as B flat. We easily recognize that these notes are an octave apart. It should take about zero seconds to notice that. Untrained musicians would struggle to do that with uncolored notes. The opening octave is then repeated. Next is a rest followed by a descending progression of notes which we immediately recognize as "G"ray (notice its not "dark "G"ray so its not G sharp), next is "F"ire orange, "E"bony (which is not highlighted to make it easier to read), "D"eep Purple, dark "C"anary yellow (C sharp or D flat), then back up to "D"eep Purple before another rest.

Now comes another series of notes which looks a lot like the first set. We have the opening dark "A"pple (A sharp aka B flat) and there's a note played below that. No, its not an "E"bony as you would expect (because it's not colored). I have purposely left it uncolored for another reason. Comparing this portion to the first set of notes can you guess what note that might be? You're right! It's another dark "A"pple (A sharp/B flat). Both notes are played an octave lower than their corresponding octaves from the opening and a quick glance at the upcoming notes tells us we're going to play something very similar to the first half of the bar only an octave lower. Allow me to point out that this was easily determined even faster than it took to read about it. And if we had an actual working model of this embodiment of the color notation system with the other features at hand we could determine every possible means of playing the passage just as quickly by simply choosing other settings on the device.

Mastering The Playing Positions

To demonstrate the last statement we'll look at various playing positions going up the neck. Since we don't have a working embodiment we won't be able to set it to a particular key but we can still get the idea by using the Scale Degree Board FIG. 2. The reader may want to block off a five (5) fret section of the board with a sheet of paper. Otherwise please follow along as best you can.

We start with the index finger on the root note key 33 at the far left side at the bottom of the board. Follow with your eyes but imagine playing the sequences. We have the R, 2, and 3 on the bottom string. Be sure to follow the "One Fret Per Finger Rule". In this case the pinky finger would play the 3. On the next string up we have the 4, 5, and 6 then continue across the strings in numeric order all the way to the top. Imagine playing through the sequence backwards and forwards until you have mastered that playing position. You can actually start and stop on any note or play them in any order. Incidentally, when encountering duplicate note options, such as the 5's in this case, either choice can be played.

Next we'll move to the second position by reaching out with the little finger and landing on either of the fourth (4) degree positions or the root note on the second string from the top. Note that the pinky finger has only moved a single fret up the neck from where we were before. However the index finger has now moved to the root position on the third (3rd) string from the bottom so it has moved two (2) frets. The reader may find it helpful to cover the first two frets with a second piece of paper leaving only 5 frets exposed. Familiarize yourself with that position noting that the pinky finger is now free to cover an additional fret going up the neck thus accessing the 7, 3, and 6 notes.

Another shift up the neck arrives at the position where the root note key 33 is marked 421. We will progress further up the neck by covering that note with the finger indicated. First the fourth finger, then the second finger, then the first finger will play that position as we progress up the neck. When we get to the position where we are covering that fret with the index finger one more shift will put the fourth (4th) finger on the root position marked 421 on the bottom string.

Again we progress up the neck one step at a time until we arrive at the 12th fret with our index finger. At this point the fingering pattern repeats. Please note that the top alignment strip 30 begins with the number 12 indicating the same position on the fret board as indicated by the 12 on the bottom alignment strip 31. Also note that we could begin with any root note by simply aligning the Scale Degree Board with the root note key on that note Likewise we could start with any of the root note keys 33 on any of the bottom three strings.

And just as you can ascend up the neck one step at a time by adjusting the pinky finger so too can you descend down the neck by reaching out to the next lower position with the index finger. Larger jumps can be made as well. The ultimate goal is for the player to be able to go from any note on any string to any other note on the neck, with any finger, knowing exactly the position he is landing in and knowing the complete fretboard layout from the new position. This is complete guitar mastery.

It should be noted that any hand movement out of a playing position would require an equal movement of the aligned inserts FIG. 1 and FIG. 2 but they could be moved together as a unit. This reinforces the concept of position playing making the user more aware of the interconnected nature of the system inherent in the embodiment.

Playing In Modes

Let's pretend for a moment that Bach had composed this piece in C Ionian instead of D Dorian. C Ionian is spelled C D E F G A B C. D Dorian is spelled D E F G A B C D. There are no sharps or flats in either scale. The notes can be played in any order in any octave. They're exactly the same scales except that they begin on different notes. What changes is the distances between the notes. For example the third degree in C Ionian (the E) is two whole steps away from the root. In D Dorian the third degree (F) is one and one half steps away from the root. It's actually a minor third thus the minor tonality.

We can actually start on any note in the key of C and build a scale with the same notes resulting in seven (7) different kinds of scales which are called "modes".

The modes in order are Ionian, Dorian, Phrygian, Lydian, Mixolydian, Aeolian, and Locrian. And just as Bach did with his Toccata and Fugue in D minor composers can achieve different effects in their compositions by using different modes. Various modes are used in different styles of music. Having mastered the Ionian (Major) scale above the student can go on to master playing in modes by simply playing the related Ionian scale but starting with a different scale degree. All he need do is set the device so that the correct note identification window (degree) is aligned with the color degree cell for the root he wishes to use. That will give him the corresponding root (in the R position) for the related Ionian scale. From there he just needs to place a special emphasis on the modal root note.

For example he may want to emulate popular guitarist Joe Satriani who often favors a Lydian mode FIG. 9. In the key of F he would play C Ionian scales placing a special emphasis on the fourth (IV) degree. By starting many of his licks with the IV degree, F, and returning to it again and again in his playing he can run those C Ionian patterns all day long and call it F Lydian. He doesn't need to learn new fingering patterns to play in modes. That's all there is to modal playing; a subject that causes great confusion to most music students.

We can also transpose a composition into any other key or mode we choose. Translating the Bach D Dorian piece into Ionian, for example, we would have the following values: vii, vii, 5, 4, 3, 2, ii, 2, vii, vii, 3, 4, ii, 2. We can now transpose the piece by setting the device to the related Ionian root note of any other Dorian scale and then easily translate the sequence back into its Dorian mode. In the key of E Dorian that would result in C, C, A, G, F sharp, E, D sharp, E, C, C, F sharp, G, D sharp, E. A similar technique can be used to convert from standard notation to tablature or vice versa.

Scale and Chord Formulas

Students can also be instructed in how to create many types of scales and chords from the pattern that appears in the view window 45. The student could simply match a given number pattern on the scale FIG. 9 and FIG. 10 or chord information chart FIG. 11 to the scale degree numbers shown in the viewing window of the device FIG. 5 and execute the notes in series or in combination.

Let us say, for example, that the performer wishes to modify the C major scale pattern to create a pentatonic minor scale. One would look at the information given for that scale FIG. 10, and see that it is created by playing the R, iii, 4, 5, and vii notes. One would simply align the "Canary" yellow cell in the position in the view window FIG. 5 that corresponds with the position of the root note (the I, 1, or R) in the desired fingering pattern and select the proper notes from the sequence in the window and execute them on the instrument neck.

Please note that each H, W, and 1.5 listed under "Scale Pattern" refers, respectively, to a Half step, Whole step, and One and one half steps up the scale. The term "step" is common knowledge among trained musicians.

Altered Scales

While there are numerous ways we can build a scale, all of them are based on the concept of raising, lowering, and/or omitting degrees from the major scale. The harmonic minor scale, for example, is spelled I, II, iii, IV, V, iv, VII. Each scale can then be used for soloing over chord progressions built from alternating degrees (the I, iii, V, and VII), of the modified scale. FIG. 10 shows the most popular altered scales used in Western music. The Major (Ionian) scale is included to provide a basis for comparison.

Of these altered scales the most common in American and British popular music, especially Rock and Country, are the Major and minor Pentatonic scales along with the Blues scale. For that reason special emphasis can be placed on the Scale Degree Board FIG. 2 to remind the user as to how these notes are to be treated.

First since none of the three make use of the VII ($7^{th}$) degree a seventh degree indicator 40 can be added to the device. As shown it has white print against a red background just like a stop sign. And that's just what it means. When playing in either pentatonic or the blues scale STOP playing the VII degree. And when playing in Major pentatonic skip that green 3 38 too. It doesn't belong to the Major pentatonic scale so go away from it. The student just needs to remember to STOP and GO when playing the Major pentatonic scales. Otherwise every note used in the Major scale is fair game so all seven fingering patterns will be the same. Just omit the red and green ones.

The minor pentatonic scale is based on the relative minor (Aeolian) mode. It occurs one and one half steps towards the nut from its relative Major. This is common knowledge among trained musicians. As it happens the relative minor scale to C Major is A minor. And as the reader should recall "A is for Apple" so we're going to include the III (3) degree in the minor pentatonic and leave out the 4 note instead. That means we play the green one for minor and leave the amber colored 4 note alone. In this case amber means caution if you're playing the minor pentatonic. So it's red, green, and amber that we need to be aware of. Just like a traffic light. As for the blues scale we can simply add the blue v (flatted fifth) note 37 to the minor pentatonic and we're home free. Again as long the student maintains awareness of the traffic lights he can run those same Ionian patterns to his heart's content.

Please note that other markers can be used to place special emphasis on particular scale degrees. A great many scales can be constructed but, as mentioned above, each and every one of them will be based on the concept of raising, lowering, and/or omitting scale degrees from the Major scale. It is not the intention of this document to present every possible permutation. Playing any scale can be as simple as selecting the correct notes from the prepared view window 45. Additional notes can be played open 44 or hammered on or pulled off anywhere on the instrument's neck as Eddie Van Halen and Stanley Jordan are known to do. It may be desirable when "tapping" notes to align the inserts without the screening device or in an embodiment where the screens can be altered in position relative to the view window.

Creating Chords

The same method can be used to create chords except that the notes would be played simultaneously instead of consecutively. Say, for example, that the user wanted to determine the correct fingering for an open C Major chord. He (or she) could simply adjust the Color Board FIG. 1 so that the "0" row of the insert appeared in the first row of the clear window of the viewing sleeve. Next the user could position the Scale Degree Board FIG. 2 so that the root note key 33 fell over the C note the "Canary" yellow cell of the Color Board. Then checking the chord spelling-chart FIG. 11 the user finds that the correct shape for that chord is X-R-3-5-R-3, where X indicates that the string is not to be sounded or should be deadened. The user could then simply finger the chord shape on the instrument that matches the pattern for those notes in the window.

Should the user then wish to modify that chord, say to a C Major 7, he could simply select that spelling from the chart, in this case X-R-3-5-7-3 and adjust his fingering accordingly changing from a root note to a seventh on the fifth string. This is not only much simpler than looking each chord up in a book but also quickly points out the relationship of one chord shape to another. As a result the student can learn the underlying structure of chord spelling rather than just a bunch of meaningless chord shapes. By matching the interval numbers from the chord-fingering chart FIG. 11 with the interval numbers of the Scale Degree Board (FIG. 2) in the viewing window (FIG. 6) a student can easily alter basic chord shapes to create many new chord variations. The open note indicator 49 can serve as a reference of additional options that may be available when determining the optimum chord voicings.

Please note that since FIG. 6 is not an actual working model and cannot be reset to other positions it is restricted to the chord spellings in the "Type E Pattern 1E" column. However that should be sufficient to demonstrate the concept.

It should be further noted that the lowest note in the spelling of the chord need not be the lowest note played. It is common knowledge among trained musicians that "Inversions" allow any note in the spelling of the chord to be played as the bottom note.

Incidentally there are three chord families used for harmony in American and West European music. Those are the Major, minor, and seventh (7) chords. Each of them has several variations which can be used to add variety to a composition. Each of these variations can be created in a variety of ways. In standard guitar tuning they typically fall into five variations based on five chord types as shown in FIG. 11. The patterns are identified by the finger that is used to play the root note for the chord. The "One Finger Per Fret Rule" does not apply to chords. The chart lists only a few examples per chord type. It is not the purpose of this document to list every possible variation. However every chord variation can be worked out in the same manner.

Intervals

Because of the equal division of oscillations across the 12-note chromatic scale, it is possible to determine the psychological or aural effects that result from the combination of those notes. That is, one can readily determine whether the combined oscillations of two notes played simultaneously or consecutively will result in consonance or dissonance, blending or clashing, bright or dark, or other types of effects FIG. 12.

Thus one can select desired sound qualities from the chart and then cross-reference with the chord chart (above) to select the proper chord and fingering patterns needed to create the aural effect. The Scale Degree Board FIG. 2 can also be used to measure the intervallic distance between any two notes FIG. 5 and then checked against the chart FIG. 12 to predict the aural results.

A selection of 12 corresponding colored markers, pencils, or highlighters can be provided so that the user can modify notes on written music sheets or tablature, which are then placed next to the device. Prepared colorized notation could also be made commercially available. The user could then follow along on his instrument by reading each colored note from the sheet music or tablature then finding it in the window of the embodied device and tactually matching the note's position to play the designated note on the instrument. The user could also choose to use this process in reverse while composing music.

After becoming more confident in his or her music reading abilities the student could choose to wean himself from this device by simply leaving off one color at a time from the written music. Thus a student who cannot read music at all would find himself becoming more and more proficient until such an aid was no longer needed for reading sheet music. However it is highly unlikely that an individual will reach a degree of musical proficiency such that they will not find this system useful for a wide number of other purposes.

Method of Construction

A broad variety of materials could be used to successfully construct such an embodiment but the components would most probably be carved, molded, laminated, or otherwise formed of plastic, metal, wood or a similar material. It could be as economically produced as printing the art from this document on a color printer, cutting out the clear areas with a single edge razor blade and laminated the paper or as finely crafted as flame maple or rosewood etched in gold leaf complete with real fret wires and strings. The visual elements could be printed on foil, paper, or cardboard and permanently attached or sealed to their corresponding bases. The view window 25 and note identification window array 15 could be constructed of clear plastic or glass or simply cut out and removed. Someone skill in the related crafts would no doubt have many ideas on the best choices of embodiment.

In addition an electronic version can be produced fairly simply by using layers. I myself have constructed a version using Front Page web page designer and another in Photoshop just by overlaying FIGS. 1 through 3 and erasing the clear areas. The figures are then manipulated in relation to one another by using the controls Photoshop, Front Page or another program normally uses. In fact that is exactly how FIG. 5 was created in Photoshop. No doubt there are fancier ways to do it but that does work.

The results could also be computed electronically. One way to do is to create a table of the variables, overlay it with the proper open and closed window pattern or equivalent and then input the fret number they wish to appear at the top of the screen and the fingering pattern they wished to use FIG. 11 and standard output could appear on a screen. This is such basic technology it should require no further explanation. Other means are or may become available. Clearly someone skilled in the area of computer programming and design would know the best program and means to create this embodiment.

A selection of 12 corresponding colored markers, pencils, or highlighters could be provided so that the user could modify notes on written music sheets or tablature. Prepared colorized notation could also be made commercially available in print or screen form. Such colorized notation could be prepared with or without the intent of using a musical slide rule to translate the notes into specific fingering patterns on a musical instrument or for voice.

ALTERNATE EMBODIMENTS

In another embodiment a Multi-Fret Isolator could be slit or otherwise incorporate a track into which alignable inserts are placed such that they have a definite range of movement restricted to the useable range of alignment. In this embodiment the Multi-fret Isolator can be constructed from two or more pieces that can be attach or detached during the installation or removal of the alignable inserts. In an embodiment where the cutaways have been removed 50, 51, 52, 53 it would be very simple to have a tab stick up from the very ends of the insert bases 54 and 55 to catch an indent inside the window frame 46.

In another embodiment the Scale Degree Board FIG. 2 would have no alignment strips 30 and 31 and is instead fed into a narrowed portion of the Multi-Fret Isolator insertion channel 57 in such manner that the markings on the Color Board alignment strips 23 and 24 can be viewed in the view window 45 of the Multi-Fret Isolator FIG. 3 without having to look through alignment strips 30 and 31 to see them. Alignment strips can also have white text against a black background if that is found to be more aesthetically pleasing.

In another embodiment window screens 42 and 43 could be adjusted in relation to the view window 45 such that a larger portion of the Color Board FIG. 1 and or Scale Degree Board FIG. 2 could be viewed while installed in the Multi-Fret Isolator FIG. 3.

A more elaborate electronic version could be produced in a manner where a real guitar could be plugged into a tuning type device that could compare the signal coming from the guitar with a series of target tone frequencies while a musical backing track played. Images of the Multi-Fret Isolator could be displayed with the target tones perhaps lighting up on a screen as each tone is to be played. A score could then be calculated. It would be like the game Guitar Hero except that it would work with a real guitar. Someone or perhaps a team of technicians skilled in the appropriate areas would have the skills to devise this as all of the technology required is currently available.

CONCLUSION, RAMIFICATIONS, AND SCOPE OF INVENTION

To paraphrase the immortal words of an old Jazz musician, "To get good first you have to learn all of the rules of music. You have to learn all the scales and all the chords. You have to understand how everything works together to create a composition. Once you've got that down you can forget it all and just play." With the help of the new invention many more musicians will be able to achieve that lofty goal.

While my above description contains many specificities, these should not be construed as limitations on the scope of the invention, but rather as an exemplification of one preferred embodiment thereof. Many other variations are possible.

In addition to the variations described above a slide rule of the same basic design can be produced for those who play piano or keyboards. Yet another device can be produced for those who play wind instruments or brass, or sing, or who compose or direct music. The needs of each would be incorporated into the design in the same manner as they have been incorporated in the displayed embodiment for guitarists and other stringed instruments.

In another embodiment the flatted symbols FIG. 12 are clear so the sharp and flat notes can appear in the currently white areas of the altered scale degree indicators 32. The flatted fifth symbol would then require a dark blue background instead of the light blue "v" symbol.

In another embodiment the alignable inserts are reversed such that the Scale Degree Board can be viewed behind the Color Board. This can involve apertures or colored filters in the Color Board. Any configuration where a scale degree pattern is specifically associated with colored notes, and particularly if those colored notes follow a mnemonic arrangement, can fall under the scope of this invention. As can any situation involving the addition of mnemonically named colors to increase comprehension in a musical environment. Accordingly, the scope of the invention should be determined not by the embodiment(s) illustrated, but by the appended claims and their legal equivalents.

I claim:

1. A method of interpreting colorized musical notation comprising:

(a) providing a colorized musical notation to be deciphered; wherein
  i) written instructions for executing at least one configuration of musical tones; are
  ii) detailed by the placement of designated musical notation markings along a plurality of horizontal lines; wherein
  iii) markings that represent musical tones which are to be sounded simultaneously are stacked vertically in groups of at least one note; and
  iv) markings that represent sequential musical tones are displayed in sequence horizontally; wherein
  v) a plurality of said designated musical notation markings have been visually enhanced with a plurality of distinct colors; whereby
  vi) each distinct color has been assigned to identify a specific musical tone;

(b) providing a colorized map wherein various fields of said distinct colors indicate the locations of corresponding musical tones found on a musical instrument;

(c) providing a computerized display surface with means for storing, selecting, and displaying various portions of said colorized map;

whereby (d) a colorized and vertically stacked group of notes is selected from said notation; and (e) at least one pertinent portion of said colorized map; is
  i) selected from storage; and
  ii) displayed on said computerized display surface; then (f) said group of notes is matched against said colorized fields of said displayed at, least one pertinent portion of said colorized map; to (g) determine the locations of each note of said group on said musical instrument; and (h) determine fingering for the execution of said notation; then (i) repeating steps (d) through (i) as required;

whereby said musical notation can be executed on a musical instrument.

2. A method of interpreting colorized musical notation as claimed in claim 1 further providing a means of identifying various intervallic relationships; whereby (a) a human operator interfaces with said machine to mark a selected colorized field on said computerized display surface as a root note position; whereby (b) said machine determines the number of musical half steps between said root note position and a plurality of other note positions; and (c) displays markings on said computerized display surface to indicate the intervallic relationships of various note positions with said root note position;

whereby said human operator engages knowledge of intervallic formulas to gain a deeper understanding of a musical composition and to make adjustments in the interpretation of said colorized musical notation so as to enhance the quality of a musical performance.

3. A method of interpreting colorized musical notation as claimed in claim 1 wherein natural tone positions are visually differentiated from altered tone positions;

wherein (a) a human operator interfaces with said machine to mark a selected colorized field on said computerized display surface as a root note position; whereby (b) said machine determines the number of musical half steps between said root note position and each of the other displayed note positions; and (c) displays markings on said computerized display surface to visually differentiate the natural tone positions from the altered tone positions in the Major scale that relates to said root note position.

4. A method of interpreting colorized musical notation as claimed in claim 1 wherein colorized fields that represent open string tones are continuously displayed regardless of which portion of said colorized map is currently being displayed on said computerized display surface.

5. A method of interpreting musical notation as claimed in claim 1 wherein the letter names of specific musical tones are the first letters of words that are mnemonically associated with the colors that are assigned to represent those tones.

6. A method of interpreting musical notation as claimed in claim 1 wherein the letter names of a plurality of specific musical tones are the first letters of the names of colors that are assigned to represent the tones.

7. A machine for interpreting colorized musical notation comprising:

(a) a storage device which is able to store a colorized map; wherein i) various fields of distinct colors indicate the locations of corresponding musical tones found on a musical instrument; wherein ii) each distinct color identifies a specific musical tone;

(b) a means which a human operator can use to select various pertinent portions of said colorized map to display on a computerized display surface;

(c) said computerized display surface which is operatively connected to said storage device for displaying said pertinent portions of said colorized map;

whereby said computerized display surface will display said pertinent portions of said colorized map; and whereby said human operator can visually match specific colors which have been used to enhance common musical notation, wherein each of said specific colors has been assigned to identify a particular musical tone, against said color locations of said pertinent portions of said colorized map to determine each note's specific location on a musical instrument.

8. A machine for interpreting colorized musical notation as specific note locations on a musical instrument as claimed in claim 7 further comprising:

(a) a means which a human operator can use to visually designate a particular colorized field of said displayed colorized map on said computerized display surface as a root note position; and (b) display a plurality of identifying markings associated with additional colorized fields of said displayed colorized map to indicate their intervallic relationships with the root note position as computed by determining the number of musical half steps between said root note position and said additional colorized fields of said displayed colorized map;

whereby a human operator engages knowledge of intervallic formulas to gain a deeper understanding of a musical composition and to make adjustments in the interpretation of said colorized musical notation;

whereby the operator enhances the quality of a musical performance.

9. A machine for interpreting colorized musical notation as claimed in claim 7 further comprising:

a means of visually differentiating the seven degrees of the Ionian scale from the other five notes of the chromatic scale; wherein (a) an interface mechanism allows a human operator to designate a particular colorized field of said displayed colorized map on said computerized display surface as a root note position; then (b) said machine computes the intervallic distance of each of the remaining note positions from said root note position to determine which of them are consistent with the whole step and half step pattern of the Ionian scale; and (c) displays markings on said computerized display surface to indicate the natural tones.

10. A machine for interpreting colorized musical notation as claimed in claim 7, wherein indices are displayed on said colorized map to guide a human operator's neck hand through a series of playing positions along the length of a fingerboard.

11. A machine for interpreting colorized musical notation as claimed in claim 7, wherein indices are continuously displayed to identify open string tones.

12. A machine for interpreting colorized musical notation as claimed in claim 7, wherein indices are displayed on said colorized map to visually differentiate between various octave ranges.

13. A machine for interpreting colorized musical notation as claimed in claim 7, further comprising a plurality of distinctly colored markers in colors consistent with those that have been assigned to represent various musical tones.

14. A machine for interpreting colorized musical notation comprising:

(a) a storage device which is able to store a colorized map; wherein i) various fields of distinct colors indicate the locations of corresponding musical tones found on a musical instrument; wherein ii) each distinct color identifies a specific musical tone;

(b) a means which a human operator can use to select various pertinent portions of said colorized map to display, on a computerized display surface;

(c) said computerized display surface which is operatively connected to said storage device for displaying said pertinent portions of said colorized map;

(d) a means which a human operator can use to visually designate a particular colorized field of said displayed colorized map on said computerized display surface as a root note position; and (e) display a plurality of identifying markings associated with additional colorized fields of said displayed colorized map to indicate their intervallic relationships with the root note position as computed by determining the number of musical half steps between said root note position and said additional colorized fields of said displayed colorized map;

whereby said computerized display surface will display said pertinent portions of said colorized map;

whereby said human operator can visually match specific colors which have been used to enhance common musical notation, wherein each of said specific colors has been assigned to identify a particular musical tone, against said locations of said pertinent portions of said colorized map to determine each note's specific location on a musical instrument;

and whereby said human operator engages knowledge of intervallic formulas to gain a deeper understanding of a musical composition and to make adjustments in the interpretation of said colorized musical notation to enhance the quality of a musical performance.

15. A machine for interpreting colorized musical notation as claimed in claim 14, wherein the plurality of intervallic markings associated with additional colorized fields of said displayed colorized map give greater prominence to a specified plurality of chromatic scale degrees than is given to the remaining scale degrees.

16. A machine for interpreting colorized musical notation as claimed in claim 14, wherein various intervallic formulas are provided for configuring groups of musical notes.

* * * * *